US006212777B1

(12) United States Patent
Gilder et al.

(10) Patent No.: US 6,212,777 B1
(45) Date of Patent: Apr. 10, 2001

(54) SAFETY RAZORS

(75) Inventors: Bernard Gilder, Berkshire; John Charles Terry, Reading, both of (GB)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 08/604,976

(22) PCT Filed: Sep. 22, 1994

(86) PCT No.: PCT/US94/10717

§ 371 Date: May 17, 1996

§ 102(e) Date: May 17, 1996

(87) PCT Pub. No.: WO95/09071

PCT Pub. Date: Apr. 6, 1995

(30) Foreign Application Priority Data

Sep. 29, 1993 (GB) ..... 9320058

(51) Int. Cl.[7] ..... B26B 21/22
(52) U.S. Cl. ..... 30/50; 30/77
(58) Field of Search ..... 30/50, 346.57, 30/77

(56) References Cited

U.S. PATENT DOCUMENTS

| | | | | |
|---|---|---|---|---|
| 1,920,711 | | 8/1933 | Pelizzola | 30/12 |
| 2,487,886 | | 11/1949 | McCune | 30/50 |
| 3,660,893 | * | 5/1972 | Welsh | 30/50 |
| 3,777,396 | * | 12/1973 | Simonetti | 30/346.57 |
| 3,786,563 | | 1/1974 | Dorion, Jr. et al. | 30/50 |
| 3,842,502 | | 10/1974 | Hagan | 30/346.58 |
| 3,938,250 | * | 2/1976 | Pery | 30/346.57 |
| 4,146,958 | | 4/1979 | Chen et al. | 30/47 |
| 4,200,976 | * | 5/1980 | Gooding | 30/50 |
| 4,932,122 | | 6/1990 | Shurland et al. | 30/50 |
| 5,067,238 | | 11/1991 | Miller et al. | 30/34.002 |
| 5,426,851 | * | 6/1995 | Gilder | 30/50 |
| B1 4,407,067 | * | 5/1987 | Trotta | 30/50 |

FOREIGN PATENT DOCUMENTS

| | | | | |
|---|---|---|---|---|
| 1369101 | * | 7/1972 | (GB) | 30/346.57 |
| WO 92/17322 | * | 10/1922 | (WO) | 30/50 |

* cited by examiner

*Primary Examiner*—Kenneth E. Peterson
(74) *Attorney, Agent, or Firm*—Fish & Richardson P.C.

(57) ABSTRACT

A safety razor blade unit including a guard, a cap, and a group of three blades with parallel sharpened edges located between the guard and cap, the first blade defining a blade edge nearest the guard having a negative exposure not less than −0.2 mm, and the third blade defining a blade edge nearest the cap having a positive exposure of not greater than +0.2 mm, the second blade defining a blade edge having an exposure not less than the exposure of the first blade and not greater than the exposure of the third blade.

11 Claims, 1 Drawing Sheet

SAFETY RAZORS

Figure 1:
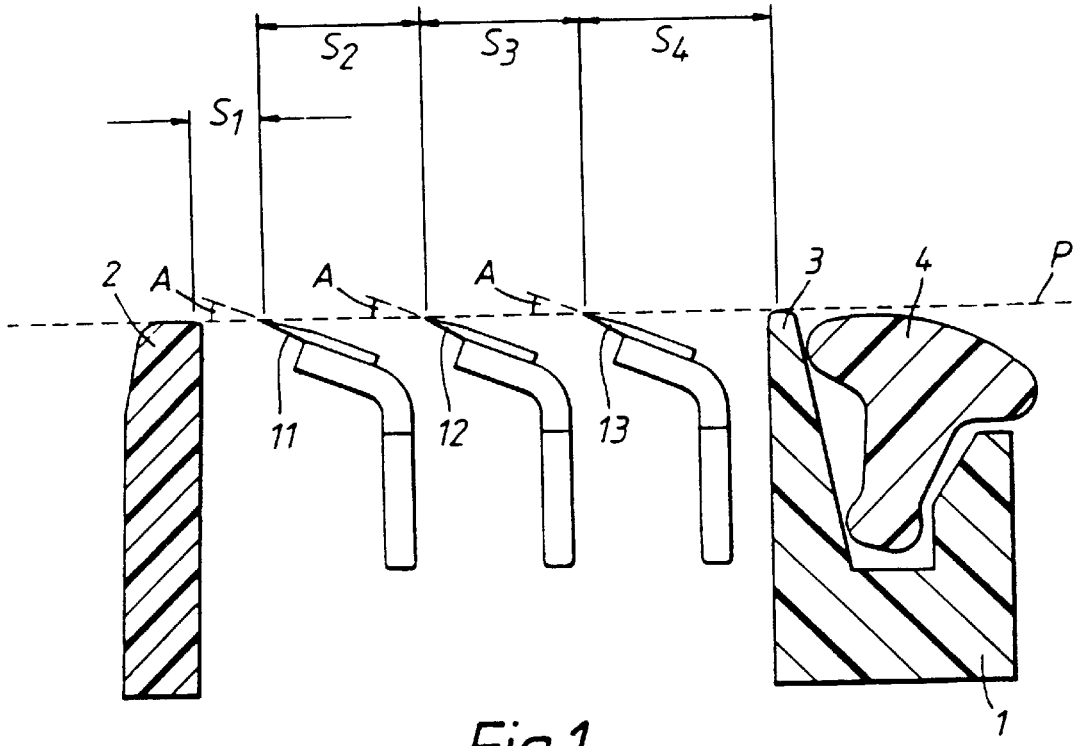

This invention is concerned with safety razors, and relates in particular to safety razors having blade units with a plurality of blades defining parallel sharpened edges arranged to pass in turn over a skin surface being shaved. As well known in the art blade units may be permanently attached to a razor handle or take the form of detachable cartridges intended to be replaced when the blade edges have become dulled. In either type of razor the blade unit may be fixed in position on the handle or pivotable about an axis parallel to the blade edges. The invention disclosed herein is applicable to all these forms of blade unit.

Safety razors having blade units with two blades have in recent years been sold in very large numbers and are generally acknowledged to give a better quality of shave, especially in terms of closeness, than single bladed razors. Furthermore, over the years there have been many written proposals to provide safety razors with several blades. A blade unit having many blades can produce a closer shave than a similar blade unit with only one or two blades. However, closeness of shave obtained is only one parameter by which razor users judge the performance of a razor. Adding extra blades can have a serious detrimental influence on other blade unit characteristics, most notably the drag forces experienced when the blade unit is moved over the skin, with the consequence that the overall performance of the blade unit can be markedly inferior despite a closer shave being obtainable. As a result, to our knowledge no razors with blade units incorporating more than two blades have been successfully marketed to date.

It has been found that with a blade unit comprising three blades, the frictional drag forces can be kept at an acceptable level while allowing an improved shaving efficiency, by setting the blades relative to each other and to guard and cap surfaces positioned in front of and behind the blade edges, according to a particular geometrical disposition. Thus, in accordance with the present invention there is provided a safety razor blade unit comprising a guard, a cap and a group of three blades with parallel sharpened edges located between the guard and cap, the first blade defining the edge nearest the guard having an exposure not greater than zero, and the third blade defining the blade nearest the cap having an exposure not less than zero.

The invention is not limited to blade units in which the blades are rigidly mounted in fixed position relative to the guard and/or cap. If the blades are capable of movement then the geometric parameters stipulated herein are those which apply when the blades are in their normal rest positions.

The blade exposure is defined to be the perpendicular distance or height of the blade edge measured with respect to a plane tangential to the skin contacting surfaces of the blade unit elements next in front of and next behind the edge. Therefore, for the three-bladed blade unit of the invention, the exposure of the first or primary blade is measured with reference to a plane tangential to the guard and the edge of the second blade, and the exposure of the third or tertiary blade is measured with reference to a plane tangential to the edge of the second blade and the cap.

It is preferred that the primary blade has a negative exposure, i.e. is located below the relevant tangent plane, and the tertiary blade a positive exposure, i.e. is located above the relevant tangent plane. This arrangement has the effect of tending to equalise the work performed by the respective blades, since in a multiple blade razor the leading blade has a tendency to do most of the work. Of course the exposure of the primary blade must not be so low that it will not make effective contact with the skin surface being shaved. The minimum acceptable exposure will be influenced by other blade unit dimensions, such as the distance from the skin engaging surface of the guard to the edge, i.e. "the span" of the primary blade. As referred to herein, "the span" means the distance from the blade edge to the skin contacting element immediately in front of that edge as measured along a tangent line extending between the said element and the blade edge. Assuming the span is not large, i.e. not more than about 1.5 mm, an exposure not less than −0.2 mm is satisfactory for the primary blade. For a span of about 0.7 mm an exposure of about −0.04 mm has been found to be very appropriate for the primary blade. With the exposure of the primary blade being not greater than zero, the span should not be very small and a minimum span of about 0.5 mm is therefore proposed. It is beneficial for the primary blade span to be smaller than, e.g. approximately half the span between the edges of the primary and secondary blades and the span between the secondary and tertiary blades.

Similarly, practical limitations will establish a maximum acceptable exposure for the tertiary blade. It should not be so great that the tertiary blade carries too high a risk of cutting the skin, for example. It is believed a maximum exposure of around +0.2 mm will ensure satisfactory results. An appropriate span for the tertiary blade is in the range of 1.0 to 2.0 mm, which is also applicable to the second blade.

The exposure of the second or secondary blade is preferably not less than the exposure of the primary blade and not greater than the exposure of the tertiary blade. A steadily increasing blade exposure has been found most effective. Therefore, the value of the exposure of the secondary blade is ideally approximately half way between the exposure values for the primary and tertiary blades, and very satisfactory test results have been obtained with all three blade edges lying in a common plane. In most embodiments a secondary blade exposure substantially equal to zero will be very satisfactory. We recommend that the tertiary blade exposure be a positive value equal in magnitude to the negative exposure of the primary blade.

Another factor which can influence drag forces associated with the blades is the shaving angle, i.e. the angle between a plane bisecting the blade tip and the plane with respect to which the blade exposure is measured. However, the blade shaving angles are not critical and values within a broad range are acceptable, for example 19–28°. It is not necessary for all three blades to have the same shaving angles, and the most effective values may depend on the span and exposure selected for each blade.

With a three-bladed safety razor blade unit having the blades disposed as specified herein we have found an enhanced overall shaving performance in comparison to a two-bladed razor.

Figure 2:
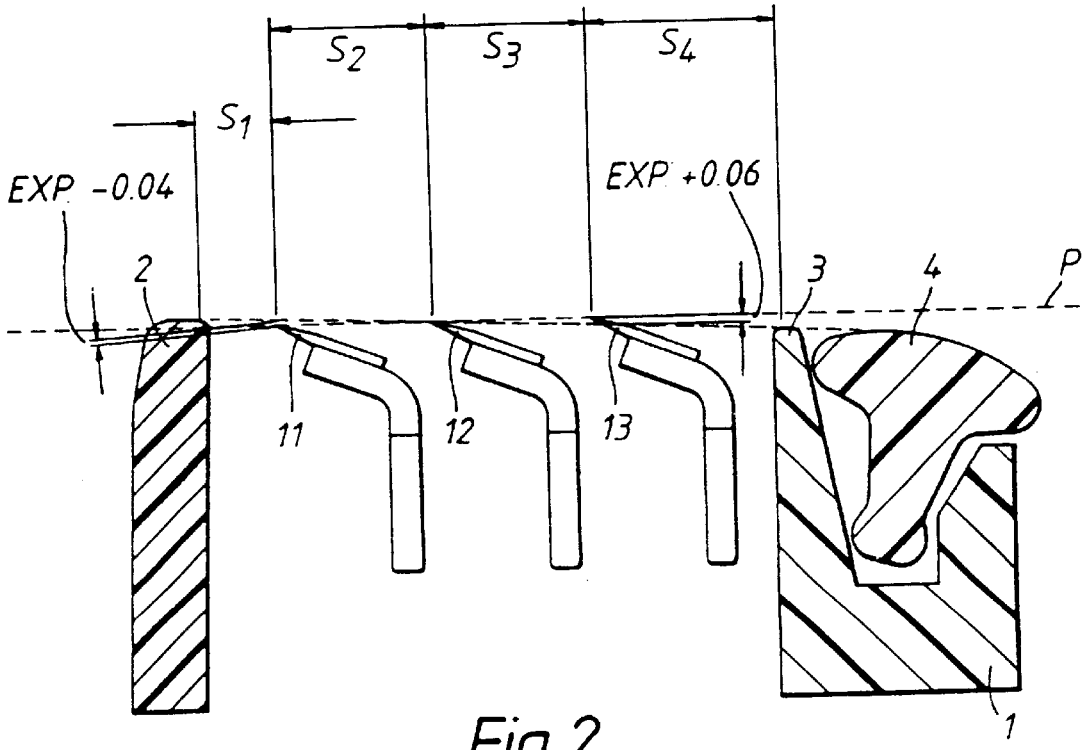

Some specific embodiments of the invention are described below with reference to the accompanying drawings in which:

FIG. 1 shows a schematic representation of a transverse cross-section through one exemplary embodiment of the invention; and FIG. 2 shows a schematic representation of a transverse cross-section through the preferred embodiment of the invention.

In each of FIGS. 1 and 2 there is illustrated a safety razor blade unit intended to be mounted on a razor handle. The blade unit may be permanently attached to the handle, e.g. in a disposable razor, or may be formed as a cartridge adapted to be mounted releasably to the handle. In either case the handle forms no part of the present invention and it does not need to be described further.

Each of the illustrated blade units has a frame 1 defining a guard 2 and a cap 3. As shown the cap comprises a lubricating strip 4 mounted on the frame. The strip may be of a form well known in the art. Carried by the frame are primary, secondary and tertiary blades 11,12,13 having parallel sharpened edges. The blades may be supported firmly by the frame to remain substantially fixed in the positions in which they are depicted (subject to any resilient deformation which the blades undergo under the forces applied against the blades during shaving). Alternatively the blades may be supported for limited movement against spring restoring forces, e.g. in a downward direction as viewed in the drawings. The basic construction and assembly of the blade units may be conventional, the novel aspects of the present invention residing in the provision of three blades set in the blade unit set in particular dispositions with respect to each other and the guard and cap.

In the blade unit of FIG. 1, the edges of all three blades lie in a common plane P, which plane is also tangential to the skin engaging surfaces of the guard and the cap and which therefore constitutes the "exposure plane" with respect to which the blade exposures are specified. In fact the exposure is equal to zero for each of the three blades 11,12,13. The span $S_1$ of the primary blade 11 is from 0.5 to 1.5 mm and is preferably substantially equal to 0.70 mm. The span $S_2$ of the secondary blade 12 and the span $S_3$ of the tertiary blade 13 have values in the range of 1.0 to 2.0 mm. They are shown equal with a value substantially equal to 1.50 mm. The edge of the tertiary blade is at a distance $S_4$ substantially equal to 1.80 mm in front of the cap. To the extent that the primary blade has zero exposure and the tertiary blade also has zero exposure, this embodiment shows an arrangement in which the exposure values of both blades are at the limit proposed according to the present invention. Nonetheless the blade unit will produce very good shaving results in terms of closeness of shave achieved with an acceptable overall performance taking into account all shaving characteristics.

As illustrated in FIG. 1, all three blades have the same shaving angle A, but this is not essential. A more favourable blade arrangement is shown in FIG. 2. The spans $S_1$,$S_2$,$S_3$ and $S_4$ are the same as those mentioned above for FIG. 1. The primary blade in this embodiment has an exposure of −0.04 mm, the exposure of the secondary blade 12 is zero, the edges of all three blades lying in a common plane P as in FIG. 1, and the exposure of the tertiary blade 13 is +0.06 mm. Thus, there is a progressive increase in blade exposure from the leading blade 11 to the trailing blade 13.

With the embodiments of the invention the blade related drag forces to which the blade unit is subjected in use are reduced by choice of the blade exposure values, but at the same time it is ensured that an enhanced shaving efficiency is secured due to there being three sharpened blades.

What is claimed is:

1. A safety razor blade unit comprising a guard, a cap, and a group of first, second, and third blades with parallel sharpened edges located between the guard and cap, the first blade defining a blade edge nearest the guard having a negative exposure not less than −0.2 mm, and the third blade defining a blade edge nearest the cap having a positive exposure of not greater than +0.2 mm, said second blade defining a blade edge having an exposure not less than the exposure of the first blade and not greater than the exposure of the third blade.

2. A safety razor blade unit according to claim 1, wherein the span between the first blade edge and the guard is substantially smaller than a span between the edges of the first and second blades and the span between the edges of the second and third blades.

3. A safety razor blade unit according to claim 2, wherein a span between the first blade edge and the guard is in the range of 0.5 mm to 1.5 mm.

4. A safety razor blade unit according to claim 1, wherein the exposure of the first blade is substantially equal to −0.04 mm.

5. A safety razor blade unit according to claim 1, wherein a span between the edges of the first and second blades is substantially equal to 1.5 mm.

6. A safety razor blade unit according to claim 1, wherein a span between the edge of the third blade and the edge of the second blade is in the range of 1.0 to 2.0 mm.

7. A safety razor blade unit according to claim 1, wherein a span between the edge of the second blade and the edge of the first blade is in the range of 1.0 to 2.0 mm.

8. A safety razor blade unit according to claim 1, wherein a span between the edges of the first and second blades and between the edges of the second and third blades is substantially equal to 1.5 mm.

9. A safety razor blade unit according to claim 1, wherein the span between the edges of the second and third blades is substantially equal to 1.5 mm.

10. A safety razor blade unit according to claim 1, wherein the exposure of the second blade is substantially equal to zero.

11. A safety razor blade unit according to claim 1, wherein the exposure of the third blade has a positive value substantially equal in magnitude to the negative value of the exposure of the first blade.

* * * * *